United States Patent [19]

Kratky

[11] 4,244,324

[45] Jan. 13, 1981

[54] LIVESTOCK CONTAINMENT DEVICE

[75] Inventor: Frank Kratky, Bellvue, Colo.

[73] Assignee: Westguard Products, Inc., Cheyenne, Wyo.

[21] Appl. No.: 66,372

[22] Filed: Aug. 14, 1979

[51] Int. Cl.[3] ..... A61D 3/00

[52] U.S. Cl. ..... 119/27; 119/98

[58] Field of Search ..... 119/27, 20, 96, 98, 119/99, 101, 103

[56] References Cited

U.S. PATENT DOCUMENTS

| | | | |
|---|---|---|---|
| 1,182,828 | 5/1916 | Winans | 119/98 |
| 3,024,766 | 3/1962 | Eveland | 119/27 |
| 3,412,711 | 11/1968 | Martensson et al. | 119/20 |

FOREIGN PATENT DOCUMENTS

| | | | |
|---|---|---|---|
| 2149517 | 4/1973 | Fed. Rep. of Germany | 119/27 |

*Primary Examiner*—Jay N. Eskovitz

*Attorney, Agent, or Firm*—Hugh H. Drake

[57] ABSTRACT

A livestock containment device features a rigid panel securable in an upright position and of a length and height to span an animal disposed alongside. A generally L-shaped vertically-oriented framework has one horizontal leg of a length similar to that of the panel. One free end portion of a leg of the framework is hingedly secured to an end of the panel. A gate is of a length to span the distance between the other leg end of the framework and the other end of the panel. The gate is hinged between the panel and the framework and also is provided with means for securing it in a closed position.

4 Claims, 1 Drawing Figure

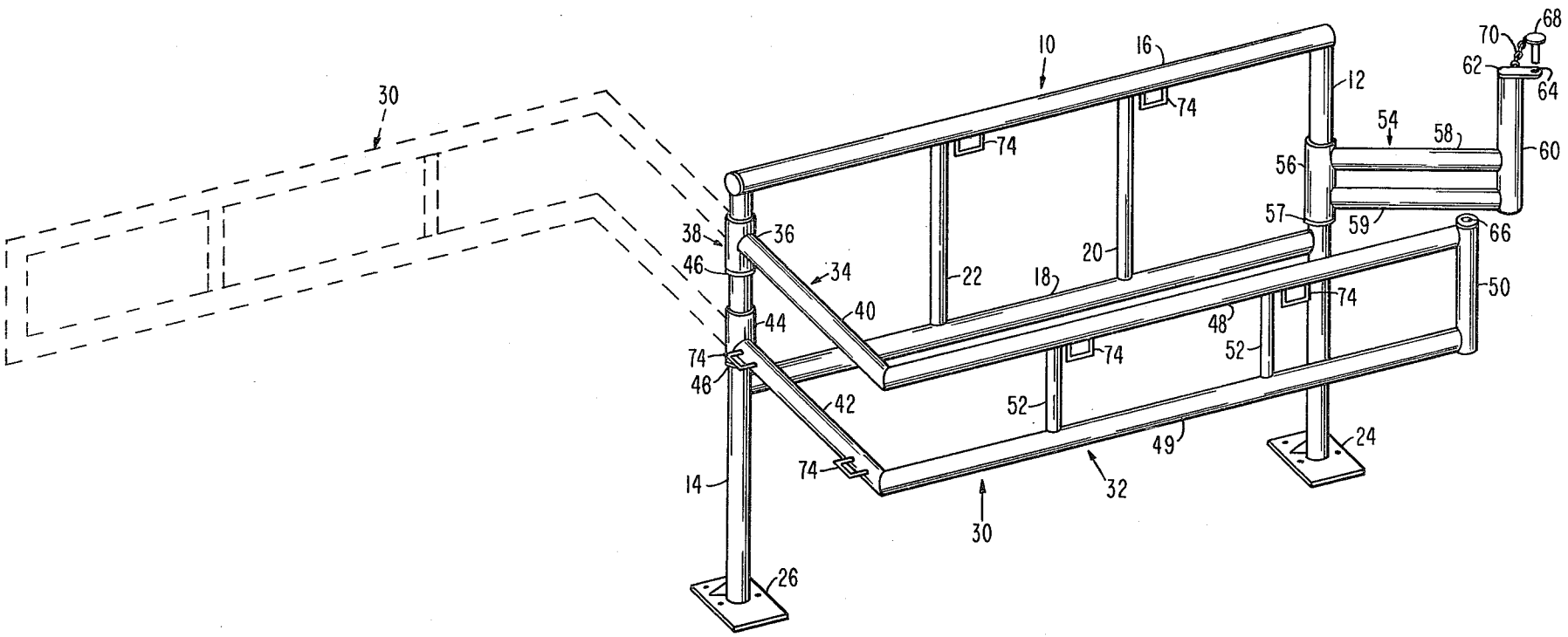
68
64
60
70
62
66
50
58
54
59
12
74
24
56
57
52
48
49
16
74
32
20
74
10
18
52
74
30
22
40
34
42
74
36
44
26
38
46
74
48
14
30

LIVESTOCK CONTAINMENT DEVICE

The present invention pertains to a livestock containment device. More particularly, it relates to an assembly effective to entrap and hold an animal.

Typically to be found on farms and ranches which handle livestock are systems of corrals and chutes for confining and directing the movement of animals. The chutes often are utilized for the purpose of driving an animal into a confinement station where, by means of either or both of a neck clamp and a body press, the animal is held in place for any of a variety of procedures such as branding, veterinary treatment of shoeing.

After having been subjected to a procedure for a time or two, many animals learn to avoid the chute that leads to the confinement station. In attempting to harrass the animal into the chute and on to the station, either the animal or the operator may incur injury.

The possibility of injuring a prize bull, a registered horse or other such animal may be even further increased when it is necessary to contain an animal without having some kind of elaborate system of corral fencing and safe chutes. Having had a valuable animal become entangled with a typical arrangement, some owners have resorted to the extremes of tranquilizing, roping or other means of subduing the animal. Each such alternative approach has its own possible source of injury to the animal.

It is accordingly, a general object of the present invention to provide a new and improved livestock containment device that overcomes deficiencies in the prior art.

Another object of the present invention is to provide a new and improved livestock containment device which enables such containment with a minimum of apprehensive reaction by the animal.

A further object of the present invention is to provide a new and improved livestock containment device which exhibits a high degree of safety both to the animal and to the operator.

In accordance with the present invention, a livestock containment device includes a rigid panel securable in an upright position and of a length and height to span an animal disposed alongside. A generally L-shaped vertically-oriented framework has one horizontal leg of a length similar to that of the panel. The free end portion of one leg portion of that framework is hingedly coupled to one end portion of the panel. A gate is of a length to span the distance between the free end portion of the other leg portion of the framework and the other end portion of the panel. Another hinged coupling is affixed between one end portion of the gate and to one of the free end portions of the other leg portion of the framework and the other end portion of the panel. Finally, the arrangement includes means for securing the other end portion of the gate to the other of the free end portion of the other leg portion and the other end portion of the panel.

While the features of the present invention which are believed to be patentable are set forth with particularity in the appended claims, the organization and manner of operation of the invention, together with further objects and advantages thereof, may best be understood by reference to the following description taken in connection with the accompanying drawing, the single FIGURE of which is an isometric view of a livestock containment device constructed in accordance with the present invention and, with dashed lines, showing an alternative positioning of one of the components.

A rigid panel 10 is securable in an upright position and is of a length and height to span an animal, such as a horse, disposed alongside. As specifically shown, panel 10 is composed of vertical end posts 12 and 14 joined between their upper ends by a rail 16 and between their intermediate portions by another rail 18. Adding rigidity to the structure are a pair of struts 20 and 22 welded or otherwise secured between rails 16 and 18 and spaced substantially equidistantly between posts 12 and 14. Posts 12 and 14 of panel 10 are intended to be firmly implanted in the underlying ground or other substrate. This is effected in accordance with the embodiment illustrated by rigidly securing anchor plates 24 and 26 respectively at the bottom ends of posts 12 and 14. It is contemplated that, in use, anchor plates 24 and 26 are to be secured to mounting bolts projecting upwardly from concrete footings or pads embedded in the ground. Of course, other mounting arrangements may be employed, as appropriate to a given situation. For example, posts 12 and 14 could be secured to other posts separately embedded into the ground. In any event, panel 10 is to be firmly mounted in an upright position as illustrated.

Further included in the device is a generally L-shaped framework 30 that has a major horizontal leg 32 of a length similar to the length of panel 10. The shorter horizontal leg 34 of framework 30 connects at its free end 36 to post 14 by means of a hinged coupling 38. In the particular embodiment illustrated, all major structural members are formed of standard steel pipe of round cross section. Thus, hinge 38 is easily formed as a sleeve slidably received upon post 14 and welded to the adjacent end of an upper rail 40 that forms a part of the shorter leg of framework 30. A parallel and lower rail 42 is similarly coupled hingedly by a sleeve 44 onto post 14. Each hinge sleeve, such as 44, is held upwardly in position by a corresponding retaining ring 46 welded or otherwise affixed in the appropriate location on post 14. At the outer end of its free leg 32, framework 30 has its two rails 48 and 49 secured in vertical relationship by a mounting post 50. In addition, framework 30 includes struts 52 vertically oriented and spaced along the lengths of rails 48 and 49 for the purpose of providing additional rigidity.

Opposite the shorter leg 34 of framework 32 is a gate 54. Again by use of a sleeve 56 affixed at one end of gate 54, and in this case slidably received upon post 12, is a sleeve 56 which serves to define a hinge element seated at its lower end upon a collar 57 secured at the appropriate location on pipe 12. As shown, gate 54 includes two vertically-spaced rails 58 and 59 that are joined at their ends opposite sleeve 56 by a member 60. Projecting laterally outward from the top of member 60 is a bracket 62 which includes a downwardly directed hole 64. When gate 54 is swung into alignment with post 50, hole 64 overlies an opening 66 defined in the top of post 50, so as to permit a lock pin 68 to be dropped within holes 64 and 66 so as to secure the gate in place. Desirably, pin 68 is retained against loss by a chain 70 affixed between pin 68 and member 60. Distributed around the resulting assembly of the different rails are a plurality of fasteners 74 to which livestock-holding restraints, such as elongated webbing, may be affixed.

In one alternative, the hinging and fastening ends of gate 54 are reversed, so that gate 54 is hinged to post 50. As another modification, the relative long and short sides may be switched, so that leg 34 and gate 54 become the longer sides of the resultant stall. In that case, the animal would be led toward panel 10 head first, so as to dispose its nose alongside and facing panel 10 which would have a shorter length so as to span only the width of the animal.

In use, pin 68 may be removed and gate 54 swung entirely to one side and out of the way. Similarly, framework 30 may be swung about post 14, so as to be disposed well out of the way and in a position such as illustrated by dashed lines in the drawing. The front side of panel 10, as viewed in the drawing, is then entirely unobstructed.

As a matter of what might be called applied horse psychology, it has been found that many otherwise obstreperous horses and the like will allow themselves to be led to a position alongside a fence. With gate 54 and framework 30 fully opened, panel 10 is like a fence section. Thus, such an animal usually may be led alongside panel 10 without difficulty. At that point, of course, he is tied to a rail or a post of panel 10. Only thereafter is framework 30 swung around the animal and locked to gate 54 so as to establish confinement. Again touching on what, perhaps, may be animal psychology, it appears that an animal, which ordinarily responds by objecting strenuously to being led into and within an already formed chute, is not nearly as bothered with the swinging of the components to confine him.

Of course, the end result is that the animal is confined in a standing position within the stall established. The network of the structure is sufficiently open that a veterinarian or other person is free to work on the animal while it is so confined. Once the animal is so confined within the enclosing structure, it usually is reasonably easy to insert strapping or webbing underneath or around the animal and between the different ones of fastening devices 74 so as either or both to secure the animal against movement in a lateral direction or support it in an upright state as in the case of the application of anesthesia.

The containment device illustrated and described will be observed to be of a nature that permits easy construction from standard components. At the same time, those components are easily designed to be of whatever ruggedness is needed for the type of animal concerned. It normally is desired that the heights of bottom rails 18 and 42 approximate the length of the legs of the animal to be confined. That allows the user to give necessary examination and/or procedures to those legs, while yet maintaining confinement.

While a particular embodiment of the present invention has been shown and described, and alternatives and modifications have been disclosed, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. A livestock containment device mountable on a surface and comprising:

a free-standing rigid panel firmly secured in an upright position and of a length and height to span an animal disposed alongside;

a generally L-shaped vertically-oriented rigid framework having one leg of a length similar to that of said panel;

means for hingedly coupling the free end portion of one leg portion of said framework to only one end portion of said panel, with the bottom of said framework being spaced above said surface, said framework being free to horizontally swing substantially around said one end portion of said panel and said framework being entirely supported in position by said coupling means;

a gate of a length to span the distance between the free end portion of the other leg portion of said framework and the other end portion of said panel;

means for hingedly coupling one end portion of said gate to one of said free end portion of said other leg portion and said other end portion of said panel;

and means for securing the other end portion of said gate to the other of said free end portion of said other leg portion and said other end portion of said panel.

2. A livestock containment device as defined in claim 1 in which said one end portion of said gate is hingedly coupled to said other end portion of said panel, and said other end portion of said gate is securable to said free end portion of said other leg portion.

3. A livestock containment device as defined in claim 1 in which each of said panel, said framework and said gate are composed of at least a pair of horizontally elongated and vertically spaced rails the lowermost one of which is spaced above the bottom of said panel by a distance approximating the leg length of said livestock.

4. A livestock containment device as defined in claim 1 in which a plurality of fastening devices are distributed along the lengths of said panel and said framework for holding restraints affixable to said livestock.

* * * * *